US008434288B2

(12) United States Patent
Titkos

(10) Patent No.: US 8,434,288 B2
(45) Date of Patent: May 7, 2013

(54) PRODUCT PACKAGE WITH AUXILIARY COMPARTMENTS

(75) Inventor: Laszlo Titkos, Shoreview, MN (US)

(73) Assignee: Target Brands, Inc., Minneapolis, MN (US)

( * ) Notice: Subject to any disclaimer, the term of this patent is extended or adjusted under 35 U.S.C. 154(b) by 810 days.

(21) Appl. No.: 12/511,668

(22) Filed: Jul. 29, 2009

(65) Prior Publication Data

US 2011/0023418 A1 Feb. 3, 2011

(51) Int. Cl.
*B65B 35/30* (2006.01)
*B65D 73/00* (2006.01)

(52) U.S. Cl.
USPC ..... 53/458; 206/462

(58) Field of Classification Search ..... 53/448; 206/461, 462, 779
See application file for complete search history.

(56) References Cited

U.S. PATENT DOCUMENTS 1,129,909 A 3/1915 Simoneaux
1,361,882 A 12/1920 List
1,792,679 A 2/1931 Davis et al.
2,040,041 A 5/1936 Clark, Jr.
2,758,778 A 8/1956 Arneson
2,979,251 A 4/1961 Frisosky et al.
3,029,936 A 4/1962 Graber
3,368,734 A 2/1968 Wainberg
3,586,232 A 6/1971 Scully
3,595,382 A 7/1971 Hofer
3,703,256 A 11/1972 Ross
3,747,831 A 7/1973 Hanson
3,871,570 A 3/1975 Garmon
4,116,378 A 9/1978 Bell et al.
4,180,165 A * 12/1979 Kuchenbecker ..... 206/461
4,244,128 A 1/1981 Russell
4,354,596 A 10/1982 Lavery
4,355,758 A 10/1982 Lavery
4,361,265 A 11/1982 Benham
4,438,846 A 3/1984 Stylianou
4,441,614 A 4/1984 Gulliver
4,457,431 A 7/1984 Lundquist et al.
4,479,318 A 10/1984 Russell (Continued)

OTHER PUBLICATIONS

"Home Corner Protector—Corrugated," Structural Packaging Guidelines for Packaging Professionals that illustrates packaging publicly used more than one year prior to Jul. 29, 2009, 3 pages.

(Continued)

*Primary Examiner* — M. Alexandra Elve
*Assistant Examiner* — John Paradiso
(74) *Attorney, Agent, or Firm* — Griffiths & Seaton PLLC

(57) ABSTRACT

A package includes a box and a tray. The box includes a rear panel, sidewalls extending around the rear panel, and a front panel and defines a storage compartment between the rear panel and the sidewalls. An opening to the storage compartment is defined opposite the rear panel, the front panel extends over a portion of the opening to the storage compartment, and the front panel includes an aperture. The tray defines an auxiliary chamber and a substantially planar, frame portion extending around the auxiliary chamber. The tray is positioned adjacent the front panel such that the frame portion is maintained between the front panel and the storage compartment and the auxiliary chamber forwardly extends though the aperture of the front panel beyond a surface of the front panel defined opposite the frame portion. Other products, assemblies, and associated methods are also disclosed.

18 Claims, 13 Drawing Sheets

U.S. PATENT DOCUMENTS

| | | | | |
|---|---|---|---|---|
| 4,682,690 | A | 7/1987 | Tiffany | |
| 4,739,353 | A * | 4/1988 | Heuer et al. | 206/316.2 |
| 4,846,775 | A | 7/1989 | Herrin | |
| 4,895,296 | A | 1/1990 | Trauschke | |
| 4,925,087 | A | 5/1990 | Ostrander | |
| D317,070 | S | 5/1991 | Ott et al. | |
| 5,018,663 | A | 5/1991 | Corso | |
| 5,039,005 | A | 8/1991 | Flaming | |
| 5,076,432 | A | 12/1991 | Wolf et al. | |
| D329,601 | S | 9/1992 | Samelson | |
| 5,456,352 | A | 10/1995 | McQueeny | |
| 5,480,090 | A | 1/1996 | Taddei et al. | |
| 5,544,806 | A | 8/1996 | Anderson et al. | |
| D383,669 | S | 9/1997 | Taylor | |
| 5,713,146 | A | 2/1998 | Reeves, Sr. | |
| 5,908,153 | A | 6/1999 | Greer et al. | |
| 6,681,983 | B2 | 1/2004 | Bill-Moore | |
| 6,739,453 | B1 | 5/2004 | Mazurek | |
| 6,854,599 | B2 * | 2/2005 | Ferrara et al. | 206/438 |
| 6,886,738 | B2 | 5/2005 | Teixidor Casanovas | |
| 6,945,398 | B2 | 9/2005 | Shumake et al. | |
| 6,997,324 | B2 | 2/2006 | Hirschel et al. | |
| 7,240,791 | B2 | 7/2007 | Alpert et al. | |
| 7,275,769 | B2 | 10/2007 | Mills | |
| 2003/0155273 | A1 | 8/2003 | Myers | |
| 2006/0249565 | A1 | 11/2006 | Wood et al. | |
| 2007/0090172 | A1 | 4/2007 | Lyon et al. | |
| 2008/0179216 | A1 | 7/2008 | Kari | |
| 2008/0265011 | A1 | 10/2008 | Specker | |

OTHER PUBLICATIONS

U.S. Appl. No. 12/201,927, entitled "Packaging With Product Window", filed Aug. 29, 2008.

* cited by examiner

PRODUCT PACKAGE WITH AUXILIARY COMPARTMENTS

BACKGROUND OF THE INVENTION

Retailers are continually evolving product packaging in hopes of discovering more effective and visually attractive means for displaying products for retail. In addition to being aesthetically pleasing to enhance the appeal of the products to potential consumers, it is generally desired to have packaging configured to protect the product(s) during transport and handling and/or to maintain multiple related parts or items as a single product for sale. The retail display and packaging of multi-item products offered for retail sale often presents specific challenges.

SUMMARY OF THE INVENTION

One aspect of the present invention relates to a package including a box and a tray. The box includes a rear panel, sidewalls extending around the rear panel, and a front panel. The box defines a storage compartment between the rear panel and the sidewalls, and an opening to the storage compartment is defined opposite the rear panel. The front panel extends over a portion of the opening to the storage compartment, the portion of the opening is less than all of the opening, and the front panel includes an aperture extending therethrough. The tray defines an auxiliary chamber and a substantially planar, frame portion extending around the auxiliary chamber. The tray is positioned adjacent the front panel such that the frame portion is maintained between the front panel and the storage compartment and the auxiliary chamber forwardly extends though the aperture of the front panel beyond a surface of the front panel defined opposite the frame portion. Other related products, assemblies and methods are also disclosed and provide additional advantages.

BRIEF DESCRIPTION OF THE DRAWINGS

Embodiments of the invention will be described with respect to the figures, in which like reference numerals denote like elements, and in which.

DETAILED DESCRIPTION

Figure 1:
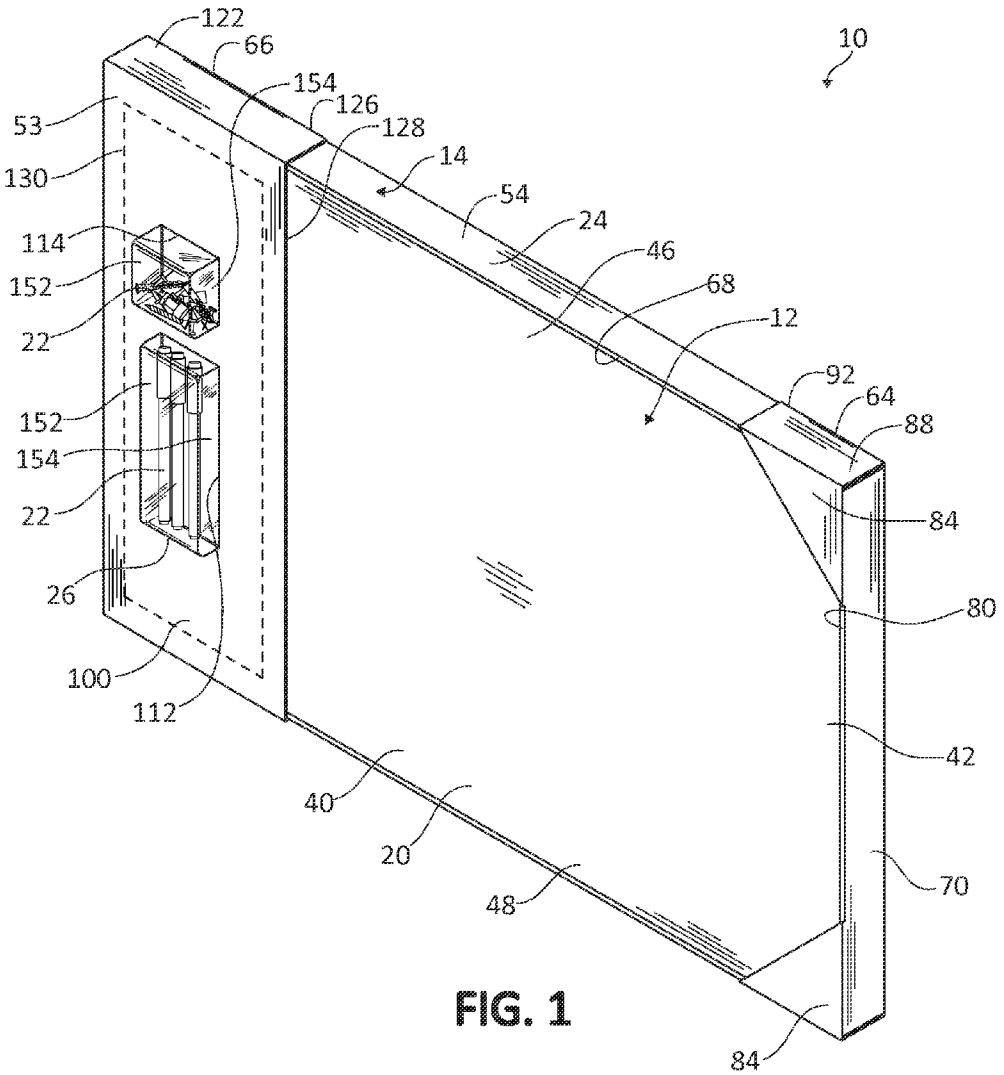
FIG. 1 is a front, perspective view illustrating a package and product assembly, according to one embodiment of the present invention.
Figure 2:
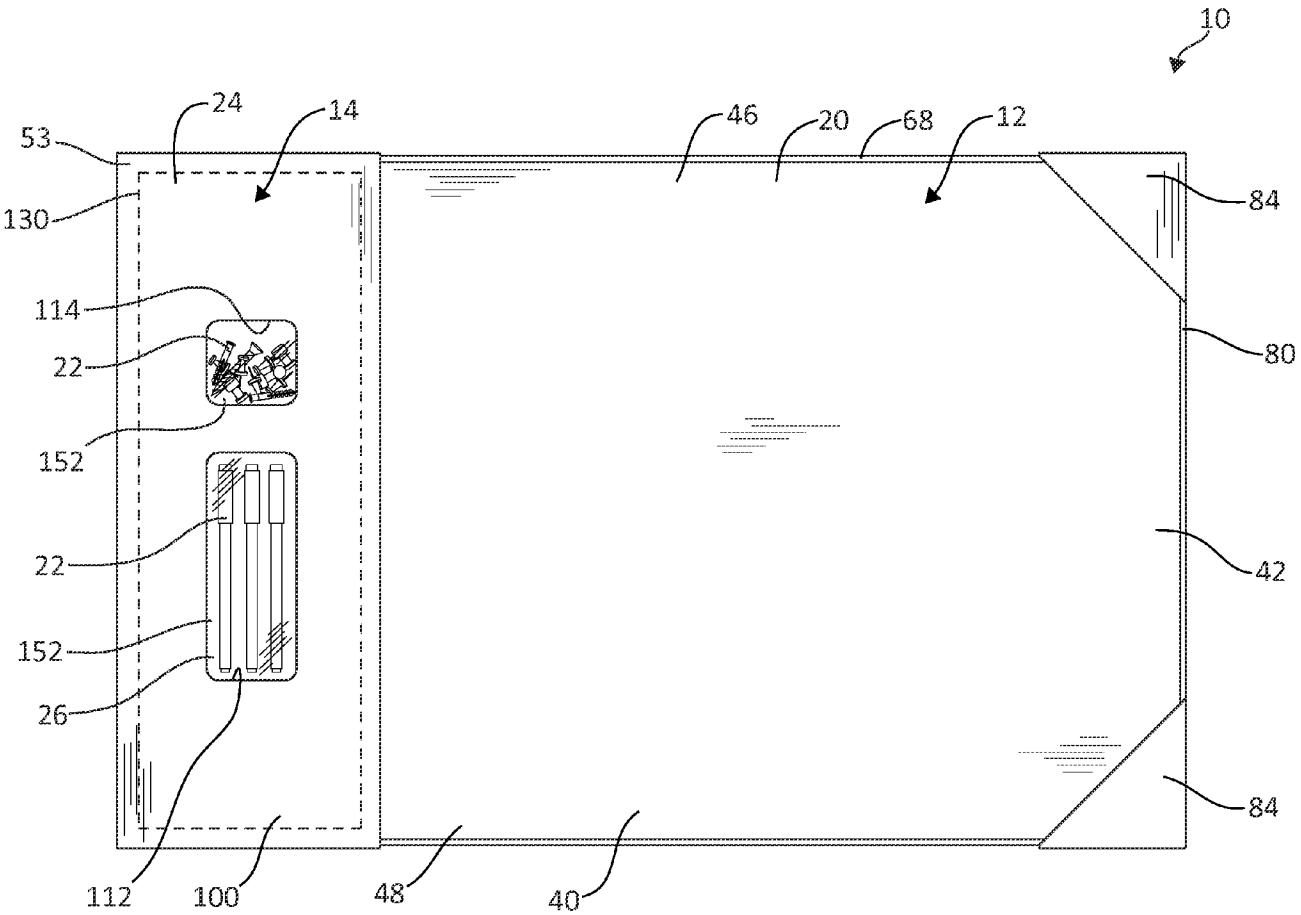
FIG. 2 is a front view illustrating the package and product assembly of FIG. 1, according to one embodiment of the present invention.
Figure 3:
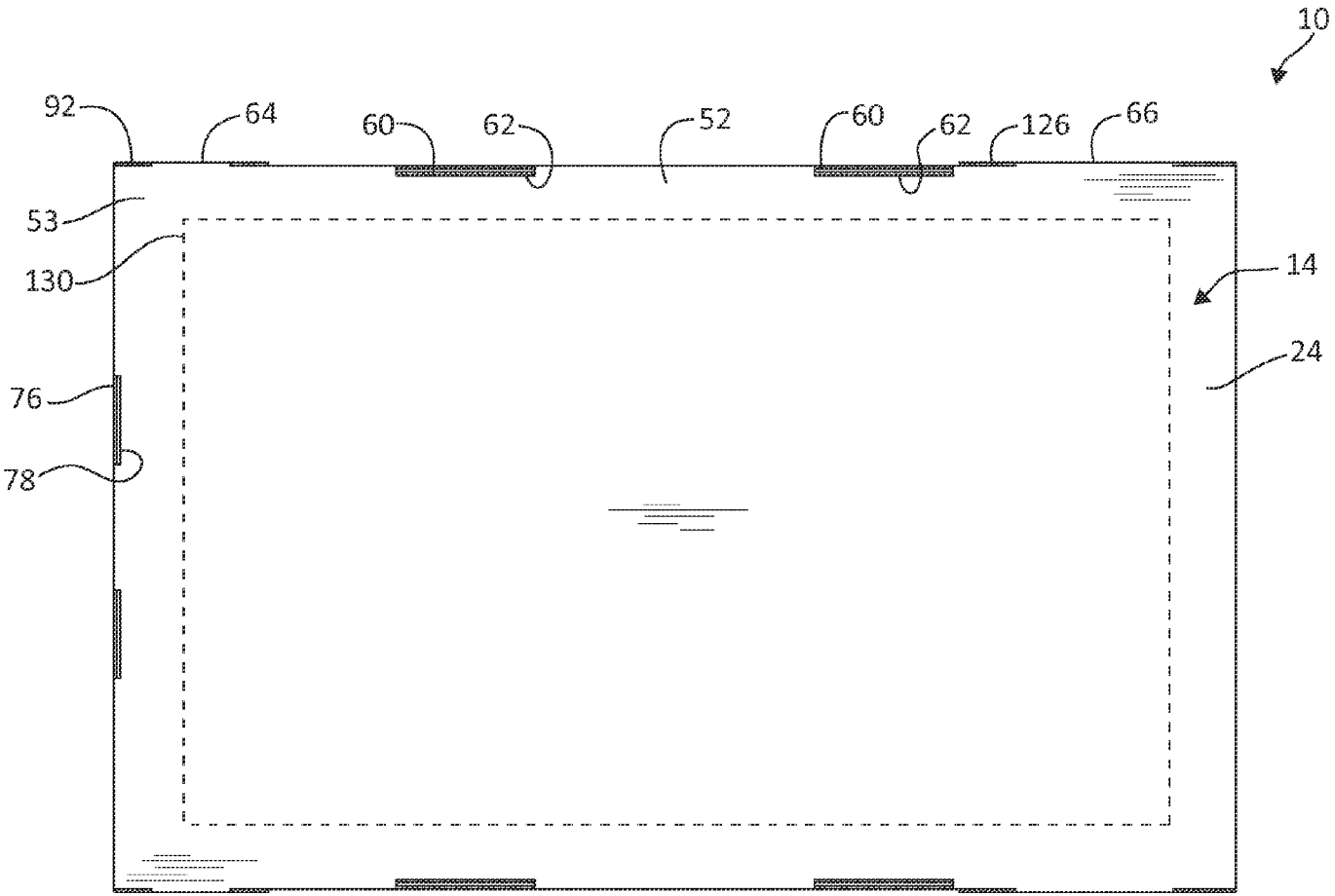
FIG. 3 is a rear view illustrating the package and product assembly of FIG. 1, according to one embodiment of the present invention.
Figure 4:
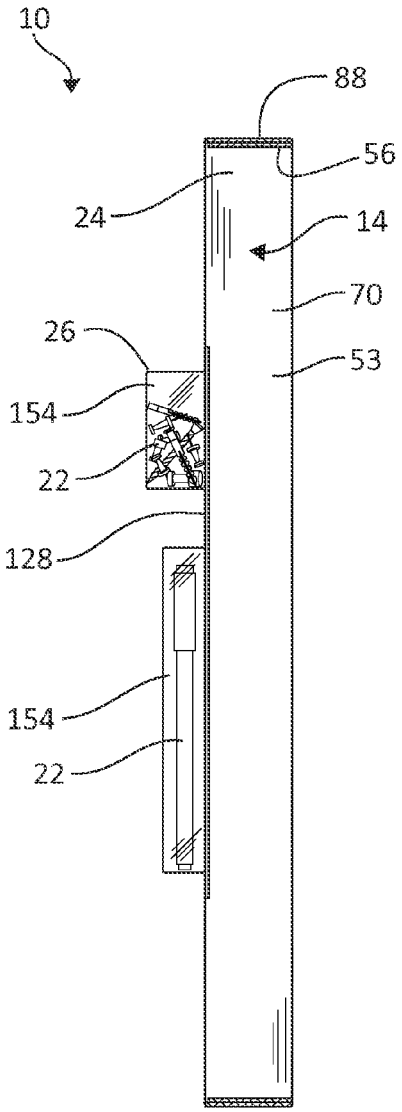
FIG. 4 is a right side view illustrating the package and product assembly of FIG. 1, according to one embodiment of the present invention.
Figure 5:
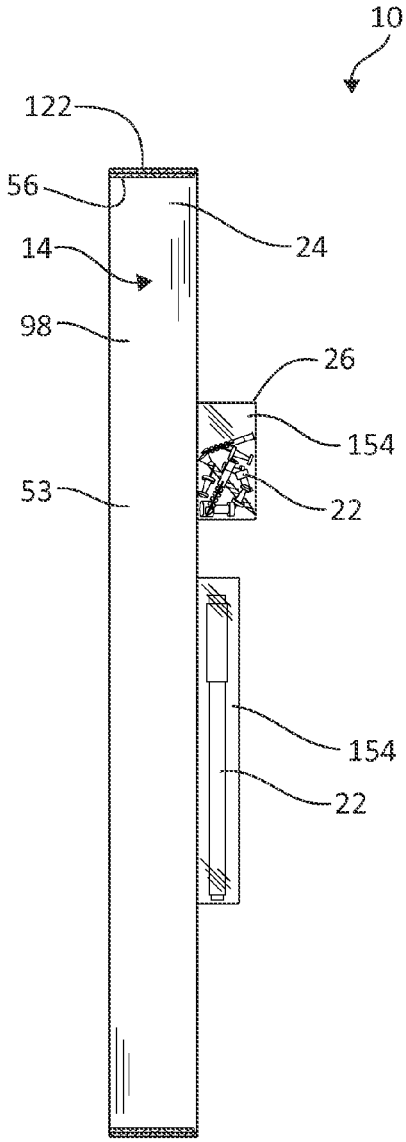
FIG. 5 is a left side view illustrating the package and product assembly of FIG. 1, according to one embodiment of the present invention.
Figure 6:
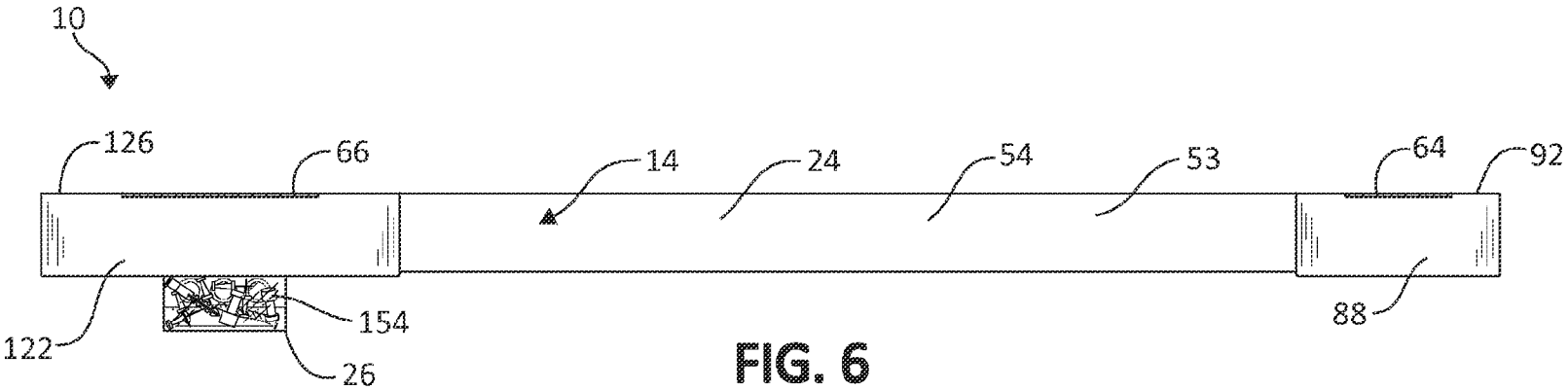
FIG. 6 is top view illustrating the package and product assembly of FIG. 1, according to one embodiment of the present invention.
Figure 7:
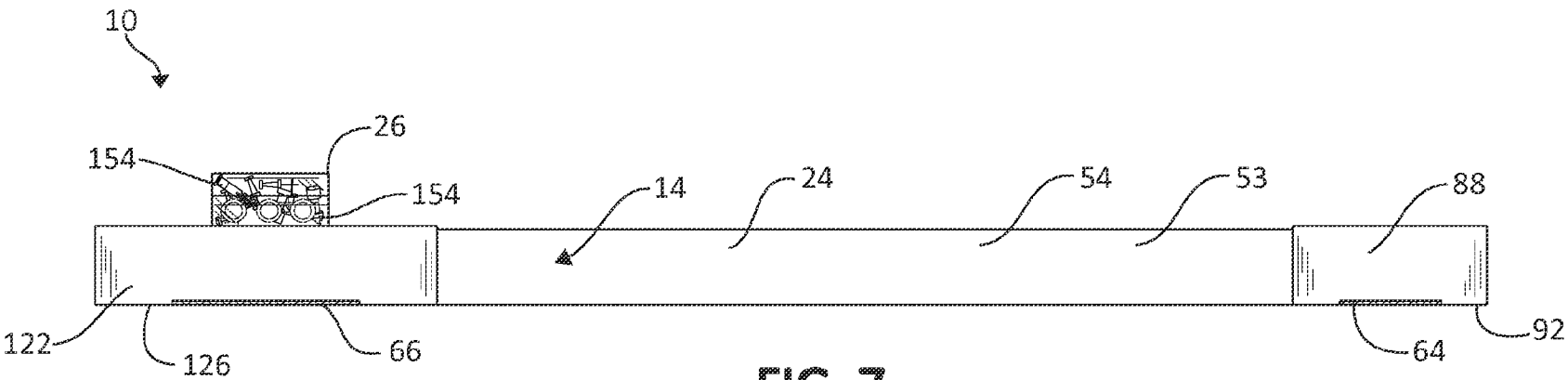
FIG. 7 is a bottom view illustrating the package and product assembly of FIG. 1, according to one embodiment of the present invention.

Embodiments of the present invention provide a package configured to hold a product for retail sale including a primary item and at least one accessory item for transport and retail display. In one example, the package substantially wraps the primary item leaving a first portion of a front of the primary item revealed to potential consumers. The package extends over a second portion of the front of the primary item. A transparent or translucent blister pack or tray extends from the package in front of the primary item and maintains accessory items corresponding with the primary item. For example, the primary item is one or more of a dry erase board, a bulletin board, a chalk board, a magnetic board, etc. and the accessory items includes one or more of dry erase markers, push pins, chalk, magnets, hanging hardware, etc. In this manner, when viewing the retail product assembly from a front perspective, the potential consumer is able to view the accessory items and the first portion of the primary item substantially simultaneously.

Turning to FIGS. 1-7, a retail package and product assembly 10 including a product 12 and a package 14 are illustrated according to one embodiment of the invention. Product 12 is any suitable product offered for retail sale. In one embodiment, product 12 includes a primary article or item 20 and one or more accessory articles or items 22. In one example, primary item 20 is a relatively flat item for hanging such as one or more of a dry erase board, a bulletin board, a chalk board, a magnetic board, art work, etc. and one or more accessory items 22 includes one or more of dry erase markers, push pins, chalk, magnets, and hanging hardware.

In one example, package 14 includes a box 24 and an accessory tray 26. Box 24 defines a storage area or chamber 28 for receiving primary item 20 and substantially wraps around primary item 20, which is placed in storage chamber 28. Accessory tray 26 forwardly extends from box 24 and defines auxiliary compartments or chambers 30 (generally indicated in FIG. 12) for maintaining the one or more accessory items 22 in front of box 24. In one embodiment, accessory tray 26 is transparent and/or translucent such that the one or more accessory items 22 are viewable through the at least one accessory tray 16. Although primarily described as one accessory tray 16 with multiple auxiliary chambers 30, it should be understood that, in one embodiment, multiple accessory trays 16 may be used with each accessory tray 16 defining one or more auxiliary chambers 30. According to the embodiment illustrated in FIGS. 1-7, box 24 maintains primary item 20 while revealing a portion of a front surface 40 of primary item 20 with accessory tray 26 extending from box 24 toward a front of assembly 10; as such, a potential consumer or other observer of assembly 10 is able to view both a revealed portion of primary item 20 and the one or more accessory items 22 through accessory tray 26 at substantially the same time.

In one embodiment, box 24 is formed from a single substantially planar piece of material such as cardboard or other suitable material configured to provide rigidity to assembly 10 while protecting corners and other portions of primary item 20 from inadvertent damage during transport and display. Box 24 is illustrated in unfolded blank form in FIG. 9 and in folded form in each of FIGS. 1-8. As such, box 24 defines a first or inside surface 51 (e.g., FIGS. 9-12 and 13) and a second or outside surface 53 (e.g., FIGS. 1-7) opposite inside surface 51. Continuing to refer to FIG. 9, in one example box 24 is divided into a plurality of panels, flaps, flanges, etc. divided from one another by a plurality of fold lines 50. More specifically, in one embodiment, box 24 defines a rear panel 52, an exterior, longitudinal side panel 54, and an interior, longitudinal side panel 56. Rear panel 52 has a length extending in the longitudinal direction (i.e., side to side in the orientation of FIG. 9) and a width extending in the lateral direction (i.e., up and down in the orientation of FIG. 9) that are substantially similar to, but just slightly larger than an overall length and width of primary item 20.

Figure 9:
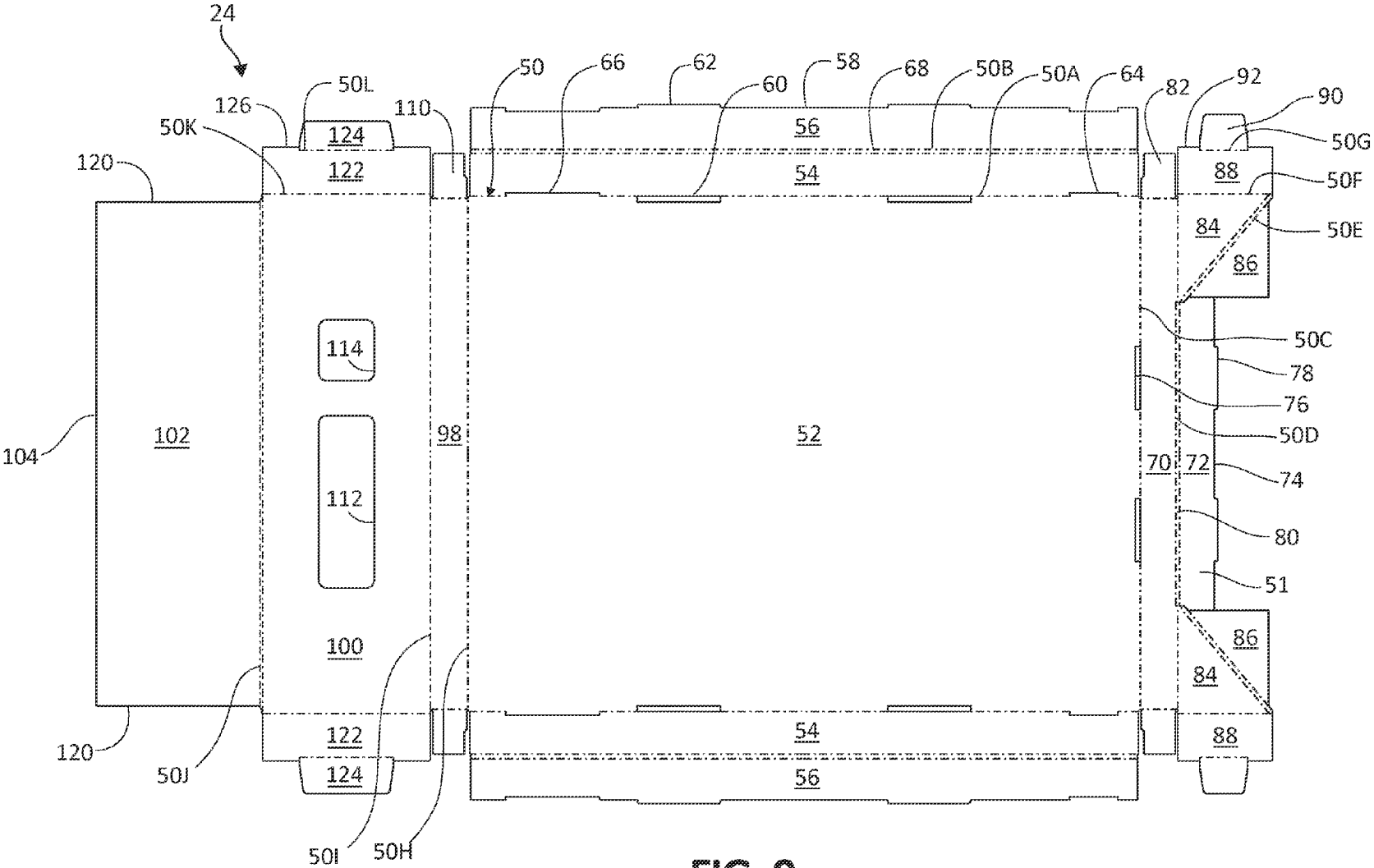
FIG. 9 is a front view illustrating an unfolded blank for a box of the package of FIG. 8, according to one embodiment of the present invention.
Figure 10:
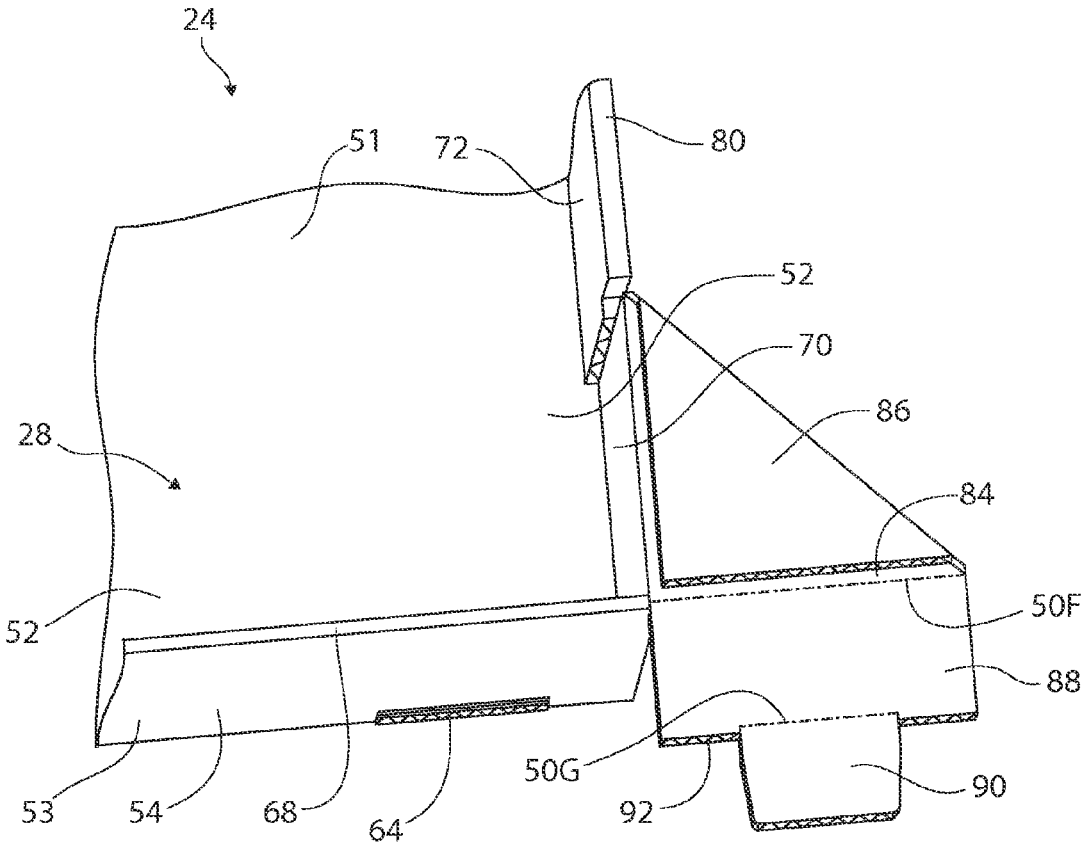
FIG. 10 is a perspective view illustrating a portion of the box of the package illustrated in FIG. 8 in a partially folded configuration, according to one embodiment of the present invention.

A fold line 50A extends along a top edge of rear panel 52, and exterior, longitudinal side panel 54 extends outwardly (i.e., upwardly as illustrated in FIG. 9) from fold line 50A to a fold line(s) 50B. Interior, longitudinal side panel 56 extends outwardly (i.e., further upwardly as illustrated in FIG. 9) from fold line(s) 50B to a free longitudinal edge 58. In one embodiment, fold lines 50A and 50B extend substantially parallel with one another. In one example, a second one of each of exterior, longitudinal side panel 54 and interior, longitudinal side panel 56 are defined along an opposite side (i.e., the bottom side as illustrated in FIG. 9) in a similar manner, but opposite direction as described above.

Figure 8:
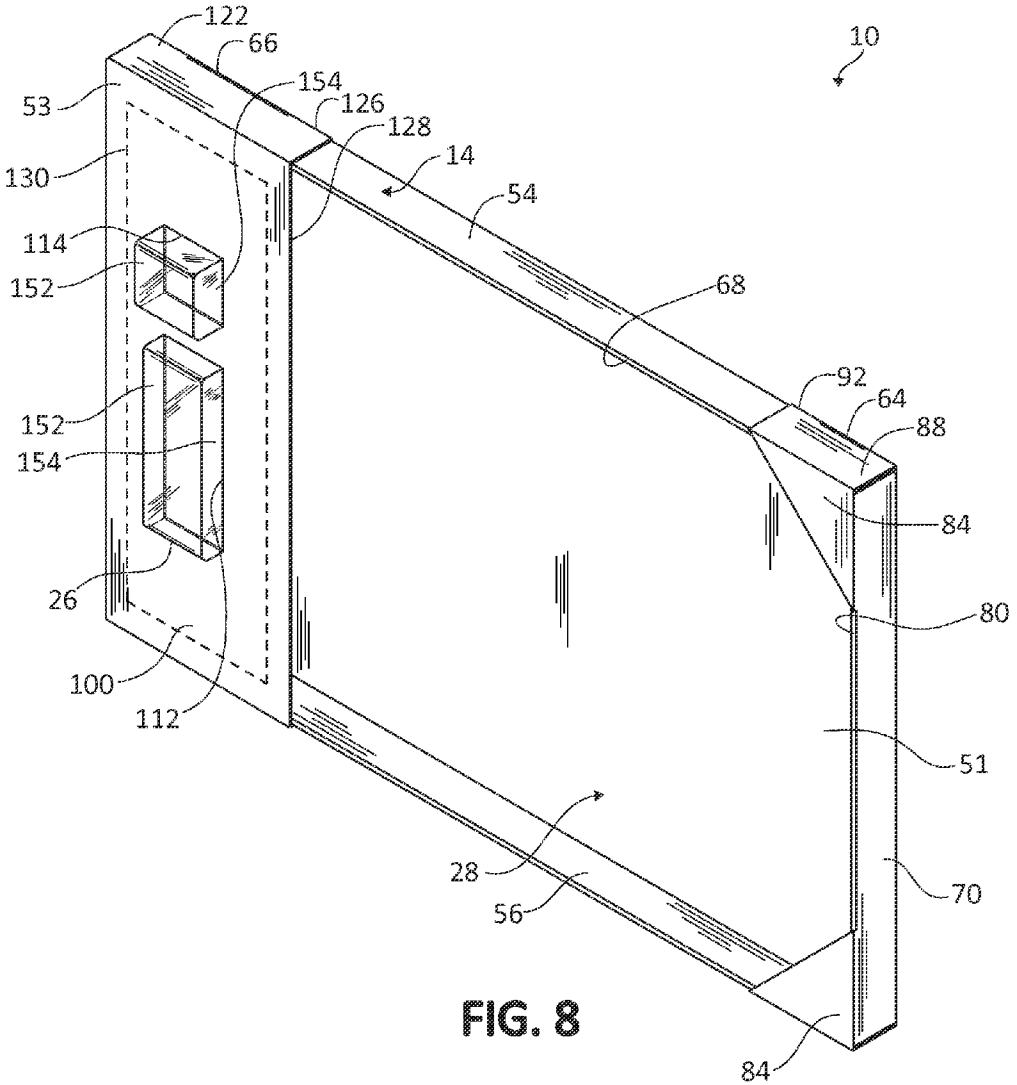
FIG. 8 is front, perspective view illustrating a package of the package and product assembly of FIG. 1, according to one embodiment of the present invention.

During assembly, exterior, longitudinal side panel 54 is folded (in other words, rotated) about fold line 50A to extend out of the page as illustrated in FIG. 9 in a direction substantially perpendicular to rear panel 52. Interior, longitudinal side panel 56 is folded about fold line(s) 50B inwardly to extend into the page as illustrated in FIG. 8 toward rear panel 52. As such, exterior and interior longitudinal side panels 54 and 56 collectively define a double thickness, longitudinal sidewall. In one embodiment, rear panel 52 defines one or more slots or elongated apertures 60 each extending substantially along fold line 50A in a substantially longitudinal manner. Each of the one or more elongated apertures 60 is longitudinally positioned to correspond with an extension or tab 62 defined along free longitudinal edge 58 and extending away from exterior, longitudinal side panel 54. In this manner, when exterior and interior longitudinal side panels 54 and 56 are folded as described above, each tab 62 seats partially within a corresponding one of the one or more elongated apertures 60 to at least partially maintain exterior and interior longitudinal side panels 54 and 56 in a folded position forming the double thickness longitudinal sidewall.

In one example, elongated cuts 64 and 66 extend from fold line 50A slightly into exterior, longitudinal side panel 54 and are configured to facilitate maintenance of box 24 in a folded position as will be further described below. More specifically, each elongated cut 64 and 66 is positioned such that when exterior, longitudinal side panel 54 is folded inwardly about corresponding fold line 50A, a slot is defined through exterior, longitudinal side panel 54 as generally illustrated with additional reference to FIG. 10. In one embodiment, elongated cuts 64 and 66 are formed near opposite longitudinal ends of exterior, longitudinal side panel 54.

In one embodiment, box 24 defines an exterior, lateral side panel 70, and an interior, lateral side panel 72. A laterally extending fold line 50C extends along a side of rear panel 52, and exterior, lateral side panel 70 extends outwardly (i.e., to the right as illustrated in FIG. 9) from fold line 50C to a second laterally extending fold line(s) 50D. Interior, lateral side panel 72 extends outwardly (i.e., further to the right as illustrated in FIG. 9) from fold line(s) 50D to a free lateral edge 74.

During assembly, exterior, lateral side panel 70 is folded (in other words, rotated) about fold line 50C to extend out of the page as illustrated in FIG. 9 in a direction substantially perpendicular to rear panel 52. Interior, lateral side panel 72 is folded about fold line(s) 50D inwardly to extend into the page as illustrated in FIG. 9 toward rear panel 52. As such, exterior and interior lateral side panels 70 and 72 collectively define a double thickness, lateral sidewall. In one embodiment, one or more slots or elongated apertures 76 are defined by rear panel 52 and extend substantially along fold line 50A. Each of the one or more elongated apertures 76 is laterally positioned to correspond with a extension or tab 78 defined along free lateral edge 74 and extending away from exterior, lateral side panel 70. In this manner, when exterior and interior, lateral side panels 70 and 72 are folded as described above, each tab 78 seats partially within a corresponding one of the one or more elongated apertures 76 to at least partially maintain exterior and interior lateral side panels 70 and 72 in a folded positioned forming the double thickness longitudinal sidewall.

In one example, a corner flange 82 extends outwardly (i.e., upwardly in the orientation of FIG. 9) from an end of external, lateral side panel 70 near fold lines 50A. In one embodiment, at least a portion of corner flange 82 is less wide in the longitudinal direction than external, lateral side panel 70. Corner flange 82 is configured to facilitate formation of a sturdy and aesthetically pleasing corner between exterior, lateral side panel 70 and exterior, longitudinal side wall 54 as will be further described below.

In one embodiment, interior, lateral side panel 72 is substantially shorter than exterior, lateral side panel 70 and is laterally centered relative to interior, lateral side panel 72. In one example, a corner panel 84 outwardly extends from exterior, lateral side panel 70, more specifically, from fold line(s) 50D, near each lateral end of exterior, lateral side panel 70. Corner panel 84 is triangular in shape and extends further away from fold line(s) 50D as it laterally extends outwardly from interior, lateral side panel 72 to define fold line(s) 50E opposite fold line(s) 50D. For example, fold line 50E extends relative to fold line 50D with an angle of between about 30° and about 60°, for example, an angle of about 45°. In one example, a triangular flap 86 extends from fold line 50E such that triangular flap 86 and corner panel 84 collectively define a substantially rectangular shape. In one embodiment, triangular flap 86 is slightly smaller that corner panel 84.

A fold line 50F is defined on an edge of corner panel 84 not otherwise defined by fold line(s) 50D and fold line(s) 50E and extends substantially perpendicularly from fold line(s) 50D. In one example, a wrap panel 88 extends laterally away from fold line 50F to a free, longitudinally extending edge 92. In one embodiment, wrap panel 88 extends between fold line 50F to longitudinally extending edge 92 a lateral distance substantially similar to or slightly larger than a lateral distance exterior, longitudinal side panel 54 extends between fold line 50A and fold line(s) 50B. A locking tab 90 extends from fold line 50G away from wrap panel 88. Fold line 50G is formed along a central portion of edge 92 where a remaining portion of edge 92 is free (i.e., has one side that does not border another portion of box 24). Locking tab 90 has a length in the longitudinal direction substantially equal to a longitudinal length of elongated cut such that locking tab 90 is configured to fit within a slot at least partially formed by elongated cut 64 when box 24 is folded. In one example, locking tab 90 is substantially shaped as an isosceles trapezoid, tapering as locking tab 90 extends away from fold line 50F.

In one embodiment, box 24 defines a lateral side panel 98, a front panel 100, and a backer panel 102 on a side of box 24 opposite exterior, lateral side panel 70 and interior, lateral side panel 72 relative to rear panel 52. A laterally extending fold line 50H extends along a side of rear panel 52 opposite fold line 50C, and lateral side panel 98 extends outwardly (i.e., to the left as illustrated in FIG. 9) from fold line 50H to a second laterally extending fold line 50I. Lateral side panel 98 is sized and shaped similar to external, lateral side panel 70. In one example, a corner flange 110 extends outwardly (i.e., upwardly in the orientation of FIG. 9) from end of lateral side panel 98 near fold lines 50A. At least a portion of corner flange 110 is less wide in the longitudinal direction than lateral side panel 98. Corner flange 110 is configured to facilitate formation of a sturdy and aesthetically pleasing corner between lateral side panel 98 and exterior, longitudinal side wall 54 as will be further described below.

Front panel 100 extends outwardly (i.e., further to the left as illustrated in FIG. 9) from fold line 50I to fold line(s) 50J. In one embodiment, lateral side panel 98 and front panel 100 each define a lateral overall distance substantially equal to a lateral overall distance of rear panel 52 and, in one example, exterior, lateral side panel 70. Accordingly, in one embodiment, corresponding fold lines 50A and 50K and, in one example, corresponding fold line 50F are substantially collinear. Front panel 100 defines one or more apertures, for example, first aperture 112 and second aperture 114. Each aperture 114 and 112 is configured to receive a portion of accessory tray 26 as will be further described below. In one embodiment, each aperture 112 and 114 is laterally centered on front panel 100 between fold lines 50I and 50J and/or apertures 112 and 114 are collectively longitudinally centered on front panel 100 between opposing fold lines 50K.

A fold line 50K is defined on each longitudinally extending edge of front panel 100. In one example, a wrap panel 122 extends laterally away from each fold line 50K to a free, longitudinally extending edge 126. In one embodiment, each wrap panel 122 extends between fold line 50K to longitudinally extending edge 126 a lateral distance substantially similar to or slightly larger than a lateral distance exterior, longitudinal side panel 54 extends between fold line 50A and fold line(s) 50B. A locking tab 124 extends from each fold line 50L away from wrap panel 88. Fold line 50L is formed along a central portion of edge 126 where a remaining portion of edge 126 is free (i.e., has one side that does not border another portion of box 24). Locking tab 124 has a length in the longitudinal direction substantially equal to a longitudinal length of elongated slot 66 at least partially defined by second elongated cut 66 such that locking tab 124 is configured to fit within elongated slot 66 when box 24 is folded. In one example, locking tab 124 is substantially shaped as an isosceles trapezoid, tapering as locking tab 124 extends away from fold line 50L.

Backer panel 102 extends from fold line 50J in a direction away from front panel 100 to define a free lateral edge 104 opposite fold line 50J. In one embodiment, backer panel 102 defines a longitudinal distance between fold line 50J and free edge 104 similar to, but just slightly smaller than a longitudinal distance defined by front panel 100 between fold lines 50I and 50J. In one example, backer panel 102 defines a free longitudinal edge 120 on each opposing end of backer panel 102 substantially perpendicular to free lateral edge 104. In one embodiment, a lateral distance between free longitudinal edges 120 is similar to or slightly less than the overall lateral distance defined by front panel 100.

In one embodiment, each of fold lines 50C, 50D, 50H, 50I, and 50J extends substantially parallel with the others of fold lines 50C, 50D, 50H, 50I, and 50J. In one embodiment, each of fold lines 50A, 50B, 50F, 50G, 50K, and 50L extend substantially parallel with one another and/or substantially perpendicularly with respect to each of fold lines 50C, 50D, 50H, 50I, and 50J.

During assembly, lateral side panel 98 is folded (in other words, rotated) about fold line 50H to extend out of the page as illustrated in FIG. 9 in a direction substantially perpendicular to rear panel 52. As such, in one embodiment, storage chamber 28 is defined between interior, longitudinal side panels 56, interior, lateral side panel 72, and front panel 100. Storage chamber 28 is sized and shaped to receive primary item 20 in a fairly snug manner such that, for example, each of interior, longitudinal side panels 56, interior, lateral side panel 72, and front panel 100 will contact a side or primary item 20 as will be further described below.

Backer panel 102 is configured to be rotated about fold line 50J substantially 180° such that a portion of inside surface 51 of backer panel 102 is positioned toward, and in one embodiment, abuts a portion of inside surface 41 defined by front panel 100. When so folded, backer panel 102 extends across apertures 112 and 114. Front panel 100 is configured to be folded about fold line(s) 50I inwardly to extend over and be spaced from rear panel 52 and, therefore, to extend over storage chamber 28 as will be described in additional detail below.

Figure 12:
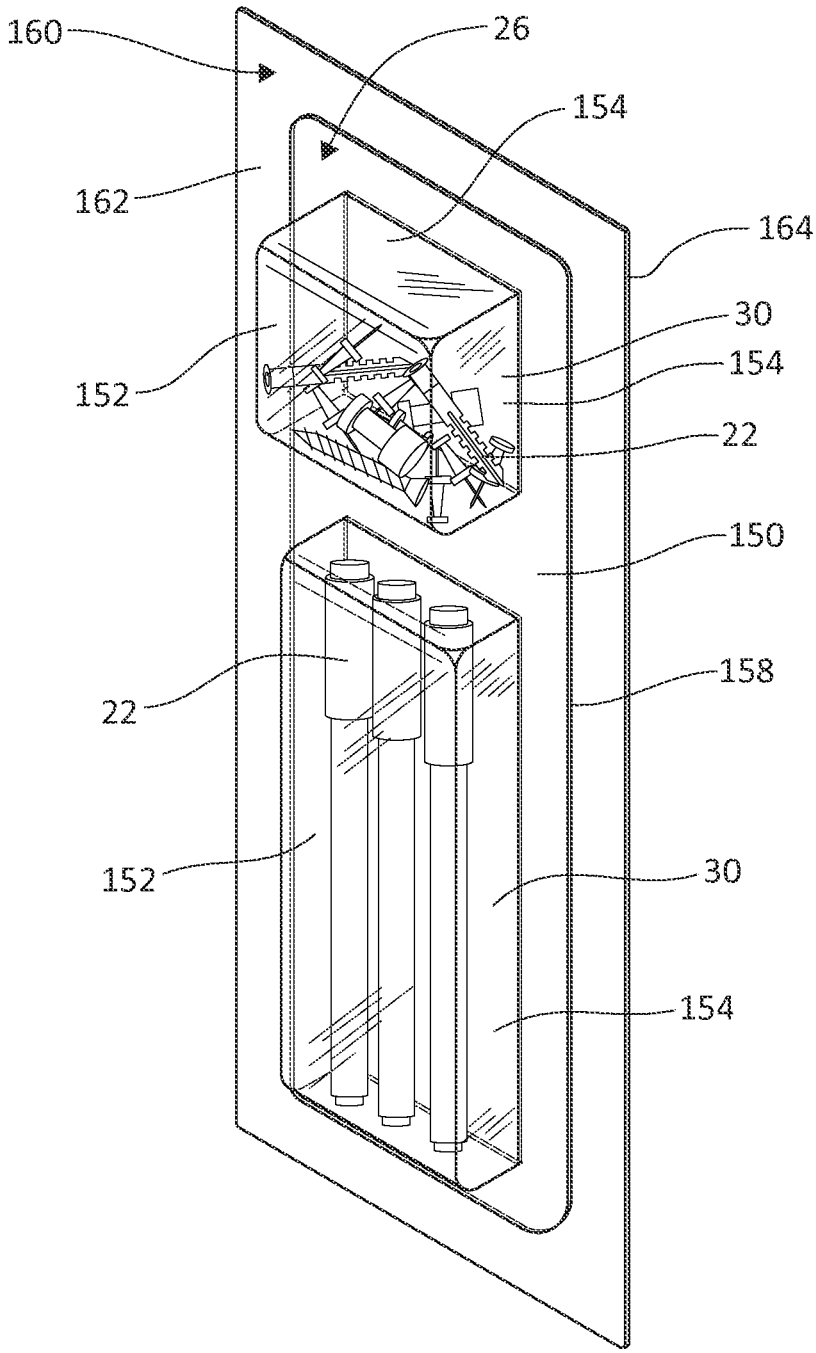
FIG. 12 is a front, perspective view illustrating an accessory insert of the package of FIG. 8, according to one embodiment of the present invention.
Figure 13:
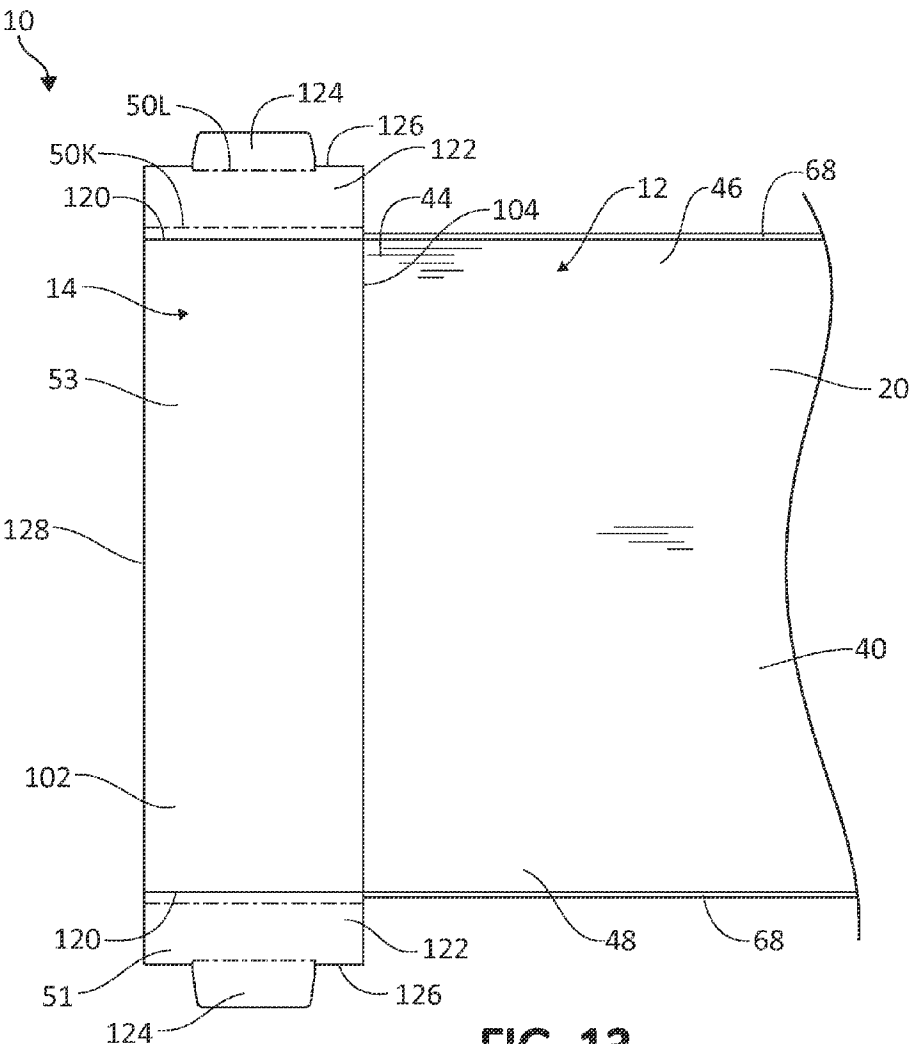
FIG. 13 is a front view illustrating the package and product assembly of FIG. 1 with the box of FIG. 9 in a partially folded configuration, according to one embodiment of the present invention.

FIG. 12 illustrates one embodiment of an accessory tray 26. In one example, accessory tray 26 is molded from any suitable, substantially transparent material (e.g., any transparent or translucent plastic and/or acrylic material) such as a material commonly used in blister or clamshell packaging. Accessory tray 26 defines a frame panel 150, front wall(s) 152, and perimeter sidewall(s) 154. Frame panel 150 defines a substantially rectangular perimeter of accessory tray 26 and is substantially planar. Each auxiliary chamber 30 is formed to extend forwardly from frame panel 150. More specifically, accessory tray 26 defines a one or more front walls 152 each corresponding with one of auxiliary chambers 30 and extending substantially parallel to, but spaced forwardly from frame panel 150. Each sidewall 154 extends substantially perpendicularly with respect to and between frame panel 150 and one of front walls 152 around an entire perimeter of front wall 152 to define auxiliary chamber 30 therebetween. Each auxiliary chamber 30 is sized and shaped in a suitable manner to receive the corresponding accessory items 22. For example, accessory tray 26 includes two auxiliary chambers 30—one being substantially elongated for receiving writing utensils or other elongated accessory items 22 and the other being less elongated and configured to receive less elongated accessory items 22 such as magnets, thumb tacks, and/or mounting hardware.

In one example, a backer card 160, more specifically, a front surface 162 thereof, is applied (e.g., adhered) to a rear surface 158 of frame panel 150. Backer card 160 is similar in shape and size or, alternatively, is larger in size than frame panel 150 such that backer card 160 entirely covers any openings to auxiliary chambers 30 defined by accessory tray 26 opposite front wall(s) 152. Backer card 160 is formed of any suitable material. In one example, backer card 160 is formed of relatively stiff cardstock, chipboard, corrugated cardboard, etc. In this manner, accessory items 22 can be placed in the respective auxiliary chambers 30 and maintained therein via backer card 160 prior to assembling accessory tray 26 with box 24 of package 14 as will be further described below.

Figure 14:
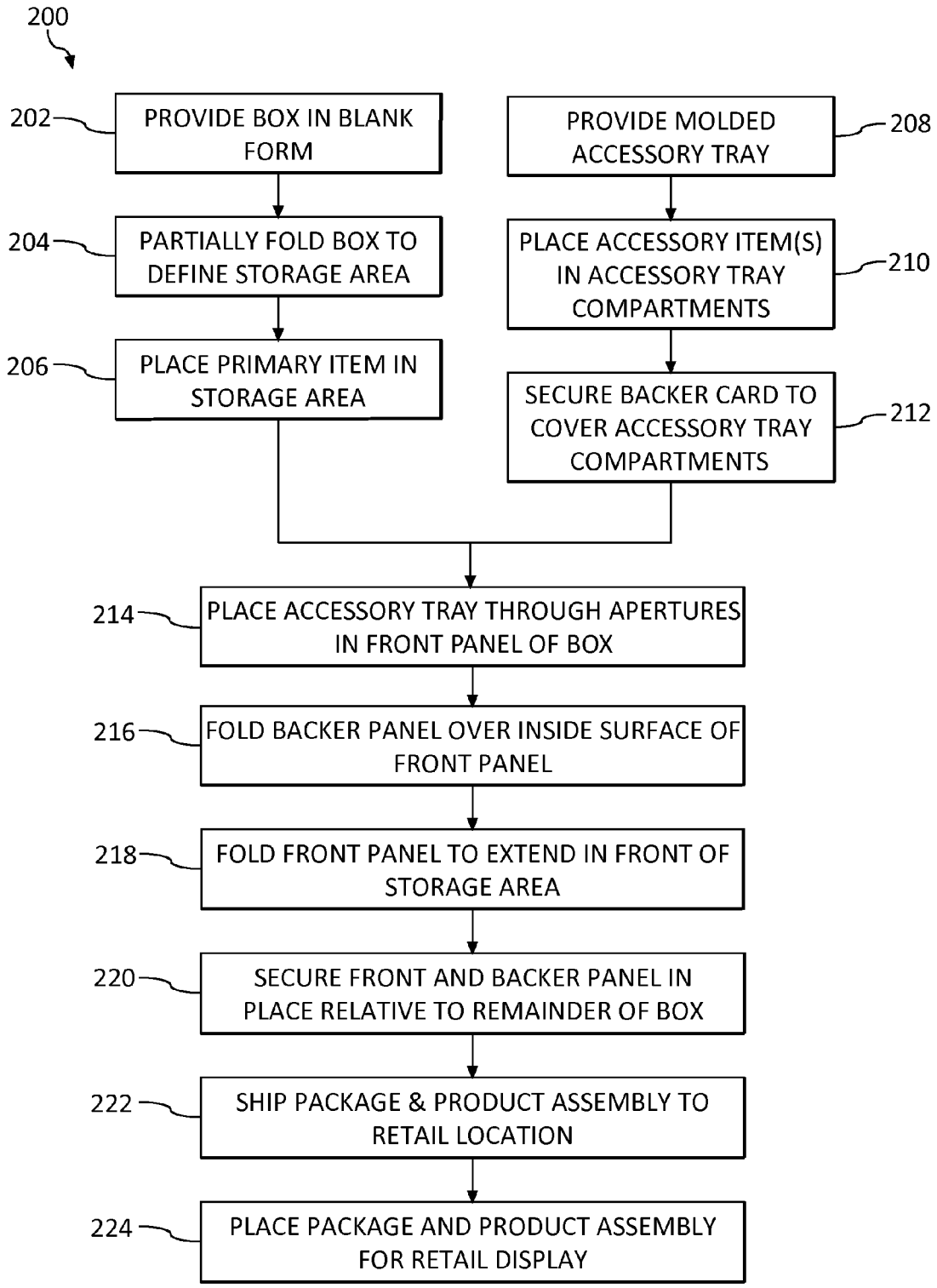
FIG. 14 is a flow chart illustrating a method of assembling the package and product assembly of FIG. 1, according to one embodiment of the present invention.

FIG. 14 illustrates one example of a method of forming package and product assembly 10 as generally indicated at 200. For example, at 202, box 24 is provided in planar blank form as illustrated with additional reference to FIG. 9, for instance, formed from corrugated cardboard. At 204, box 24 is partially folded to define storage chamber 28. More specifically, in one embodiment, each exterior, longitudinal side panel 54 is folded upwardly about fold line 50A to extend substantially perpendicularly with respect to rear panel 52. Each internal, longitudinal side panel 56 is folded about 180° about fold line(s) 50B. Tabs 62 formed along each free longitudinal edge 58 of the respective internal, longitudinal side panel 56 are each tucked into or otherwise received by a corresponding elongated aperture 60 to hold longitudinal side panels 54 and 56 in position. Once so folded, each pair of longitudinal side panels 54 and 56 collectively defines a dual-panel, longitudinally extending sidewall that is substantially perpendicular to rear panel 52.

In one embodiment, a dual-panel, lateral sidewall is similarly formed. More specifically, in one embodiment, external, lateral side panel 70 is folded upwardly about fold line 50C to extend substantially perpendicularly with respect to rear panel 52. In one example, each corner flange 82 is folded relative to external, lateral side panel 70 and is inserted in between exterior, longitudinal side panel 54 and interior, longitudinal side panel 56 at the most proximate ends thereof, respectively, to form a closed corner of box 24 (see, e.g., FIG. 8). Each internal, lateral side panel 72 is folded about 180° around fold line(s) 50D. Tabs 78 formed along each free lateral edge 74 of the respective internal, lateral side panel 72 are each received by a corresponding elongated aperture 76 to hold lateral side panels 70 and 72 in position. Once so folded, each pair of lateral side panels 70 and 72 collectively defines a dual-panel laterally extending sidewall that is substantially perpendicular to rear panel 52 and each dual-panel, longitudinally extending sidewall.

In one embodiment, partially folding box 24 at 204 includes folding lateral side panel 98 upwardly about fold line 50H to extend substantially perpendicular to rear panel 52 and placing corner flanges 110 between the respective and proximate end portions of longitudinal side panels 54 and 56 near each end of lateral side panel 98 to form closed corners of box 24. As such, lateral side panel 98 provides a single panel, lateral sidewall of box 24. In the manner described above, the two opposing, dual-panel, longitudinally extending sidewalls, the dual-panel, laterally extending sidewall, and lateral side panel 98 collectively define storage chamber 28 therebetween. In one embodiment, rear panel 52 covers a rear side of storage chamber 28 while storage chamber 28 is open toward a front of box 24 opposite rear panel 52.

At 206, primary item 20 is placed in storage chamber 28 such that the four perimeter sides or surfaces of primary item 20 substantially abut the corresponding sidewalls of box 24 defined above and a rear side or surface of primary item 20 abuts rear panel 52. As such, five of six sides or surfaces of primary item 20 directly abut a portion of box 24. In view of the above, rear panel 52, the two opposing, dual-panel, longitudinally extending sidewalls, the dual-panel, laterally extending sidewall, and lateral side panel 98 collectively define one example of means for receiving and/or means for maintaining primary item 20. To partially secure primary item 20 in place and/or to form a stronger box 24 near the corners thereof, box 24 is further folded and secured in the folded position. More particularly, in one embodiment, flap 86 is folded about 180° around fold line(s) 50E such that portions of inside surface 51 defined by flap 86 abut portions of inside surface 51 defined by corner panel 84 as illustrated with additional reference to the partially folded of box 24 in FIG. 10. Additionally referring to FIGS. 1-8 and 10, then, corner panel 84 is folded about portions of fold line 50D defined between corner panel 84 and external, lateral side panel 70 to extend in front of and substantially parallel to rear panel 52 and, therefore, substantially perpendicularly to the dual-panel, lateral sidewall of box 24. When so folded, in one embodiment, flap 86 interfaces with a front surface 40 of primary item 20 such that primary item 20 is interposed and maintained between rear panel 52 and flap 86 as well as corner panel 84.

To secure corner panel 84 in place, in one example, wrap panel 88 is folded about fold line 50F about 90° to extend over a portion of the respective exterior, longitudinal side panel 54. Locking tab 90 is, in turn, rotated about fold line 50G and placed into the corresponding slot defined by first cut 64. Since locking tab 90 is sized to fit tightly within the slot, locking tab 90 maintains corner panel 84 and wrap panel 88 in place.

Before, after, and/or substantially or somewhat simultaneously with operations 202, 204, and 206, in one embodiment, operations 208, 210, and 212 are performed. For example, at 208, molded accessory tray(s) 26 are provided. At 210, accessory item(s) 22 are each placed in a corresponding auxiliary chamber 30 defined by accessory tray(s) 26. Each accessory tray 26 or each auxiliary chamber 30 is one example of means for containing accessory item(s) 22. Subsequently, at 212, backer card 160 is secured to rear surface 158 of frame panel 150 of accessory tray(s) 26 to maintain accessory item(s) 22 within the corresponding auxiliary chamber 30. Backer card 160 is one example of means for backing accessory tray(s) 26 to enclose accessory item(s) 22 therebetween, e.g., within auxiliary chamber(s) 30.

Figure 11:
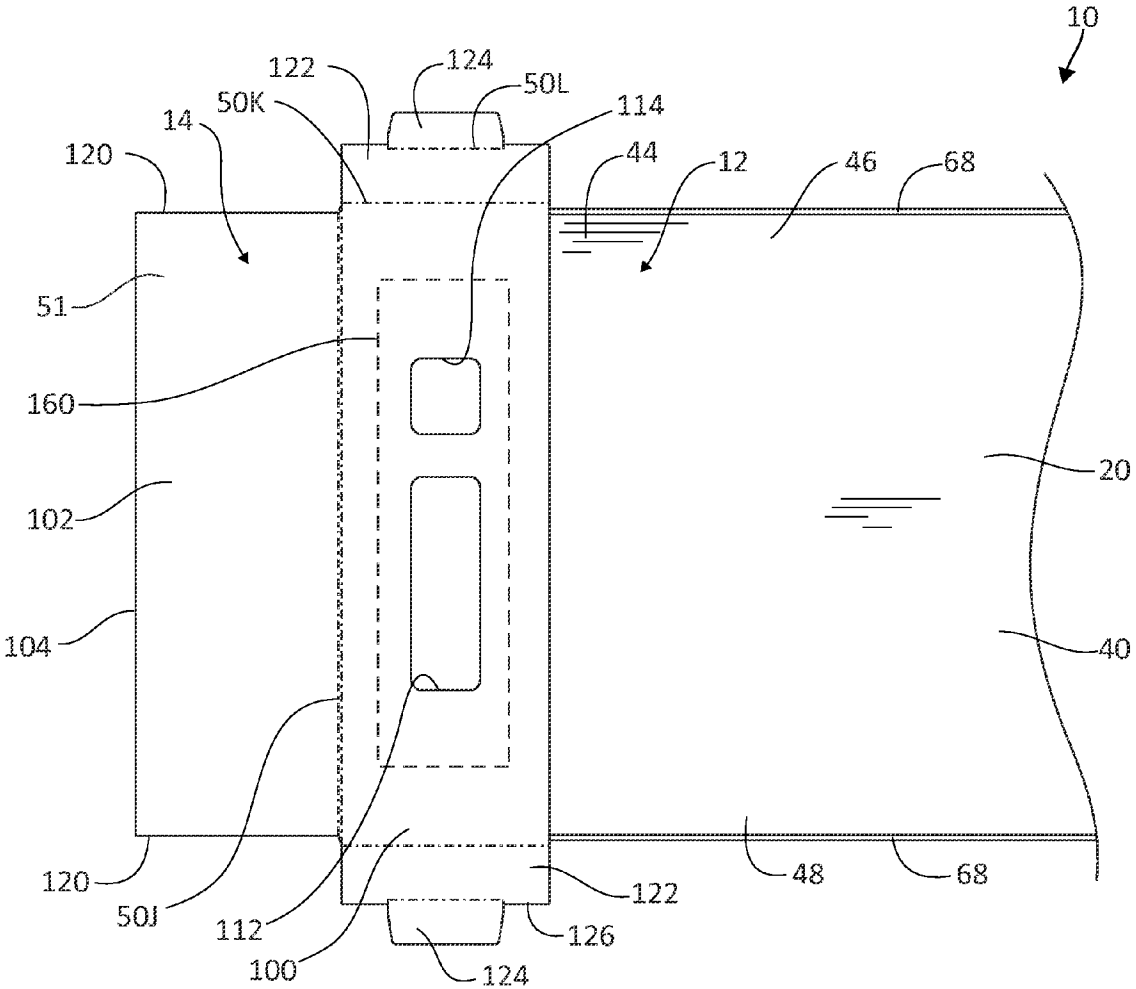
FIG. 11 is a front view illustrating the package and product assembly of FIG. 1 with the box of FIG. 8 in a partially folded configuration, according to one embodiment of the present invention.

At 214, accessory tray(s) 26 are positioned with respect to box 24. More specifically, each protruding portion (e.g., including the corresponding front wall 152 and sidewalls 154 of defining each auxiliary chamber 30) of each accessory tray 26 is placed face down through apertures 112 and 114 defined in front panel 100 of box 24 such that backer panel 160 is positioned substantially as indicated in FIG. 11, and portions of each accessory tray 26 extends in front of front panel 100 (see, e.g., FIGS. 1 and 4-8). In one embodiment, front panel 100 serves as one example of means for maintaining accessory tray 26. In one embodiment, upon positioning, front surface 158 of frame panel 150 and front surface 162 of backer card 160 are each positioned toward and/or abut a portion of inside surface defined by front panel 100 around aperture 112 and 114. After each accessory tray 26 is so positioned, then, at 216, backer panel 102 is folded about 180° around fold line(s) 50J such that portions of inside surface 51 defined by backer panel 102 contact portions of inside surface 51 defined by front panel 100 as illustrated with additional reference to FIG. 13. In this manner, backer panel 102 extends over rear surface 164 of backer card 160 such that backer card 160 is interposed and maintained in place relatively tightly between backer panel 102 and front panel 100.

Subsequently, at 218, front panel 100 is folded about fold line 50I to extend substantially parallel to rear panel 52 and, therefore, substantially perpendicularly to lateral side panel 98. When so folded, in one embodiment, backer panel 102 interfaces with front surface 40 of primary item 20 such that primary item 20 is maintained between rear panel 52 and backer panel 102 as well as front panel 100. In one embodiment, at 220, wrap panel 122 is folded about fold line 50K about 90° to extend over a portion of the respective, exterior, longitudinal side panel 54 to at least partially secure front panel 100, backer panel 102, and accessory tray(s) 26 in place. Locking tab 124 is, in turn, rotated about fold line 50L and slid into the corresponding slot defined by second cut 66. Since locking tab 124 is sized to fit tightly within the slot, once so positioned, locking tabs 124 maintain front panel 100 and wrap panel 122 in place relative to a remainder of box 24, etc.

As a result of the above-described assembly, a package and product assembly 10 is provided in which primary item 10 and accessory items 22 can both be visually observed by a potential consumer substantially simultaneously. The actual visual observation of the items increases the appeal of the items as compared to mere pictures of the items on a box package as commonly seen in conventional packages. In addition, the box construction provides a reinforced and sturdy box 24 configured to withstand the impact of shipping and transport in a manner not only protecting product 12 but also in a manner configured to maintain the aesthetic integrity of package 14 for future placement on retail display to potential consumers in a retail setting. Accordingly, at 222, package and product assembly 10 is shipped to a retail location directly and/or via various entities and/or distribution centers. At 224, package and product assembly 10 is received by the retail setting and is placed for retail display to potential consumers, e.g., is placed on a retail shelf or hung from a retail support. Other method variations will be apparent to those of skill in the art upon reading the present application.

Figure 15:
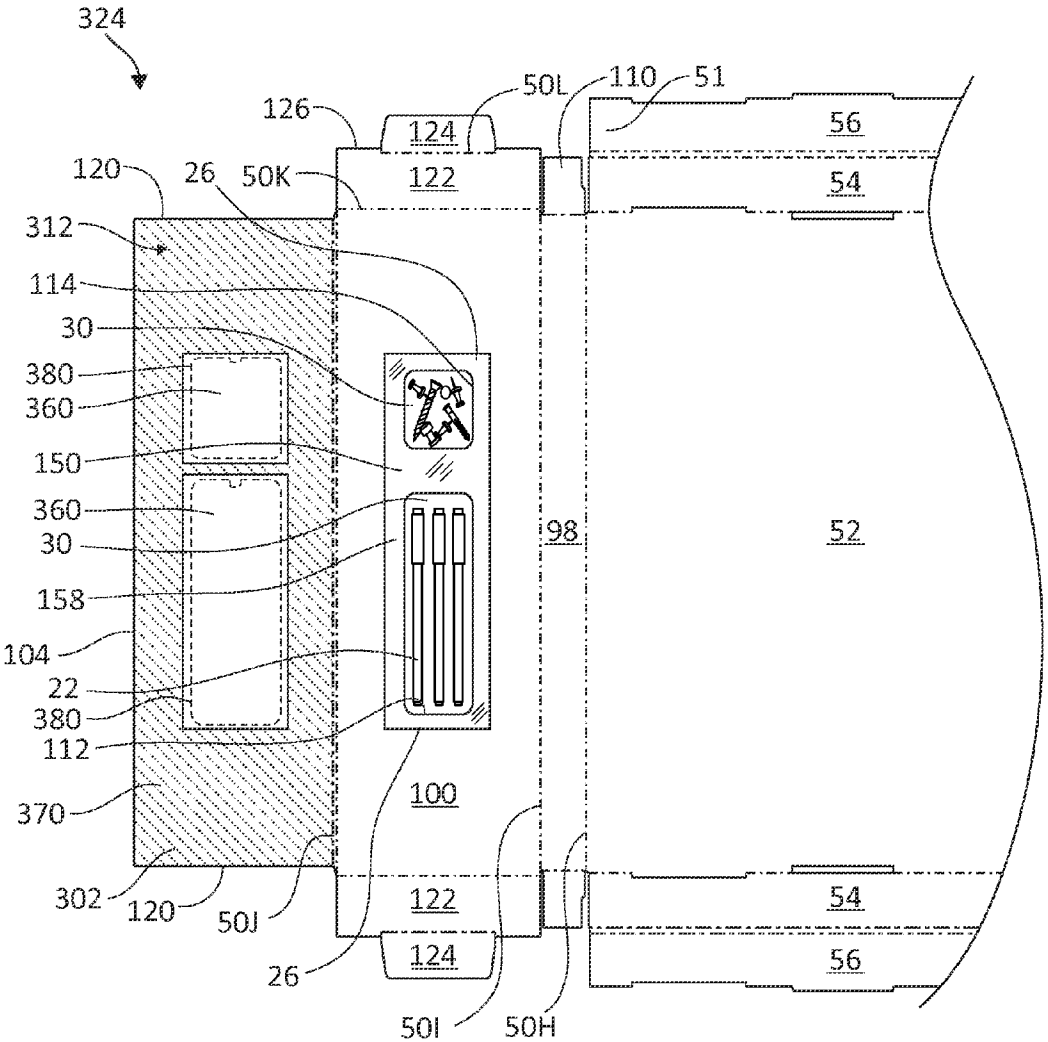
FIG. 15 is a front view illustrating an unfolded blank for a box of a package and product assembly, according to one embodiment of the present invention.

Embodiments other than those specifically described above are also contemplated. For example, FIG. 15 illustrates a slightly different embodiment of a package as generally indicated at 312. In one embodiment, package 312 includes box 324, which, other than the differences specifically enumerated herein, is substantially similar to box 24 described above, and accessory tray 26 without backer card 160. Backer panel 302 is substantially similar to backer panel 102 but additionally includes backer fields 360 printed or otherwise applied thereto (e.g., adhered to) in a manner providing a visually pleasing background for viewing accessory items 22 through portions of accessory tray 26. For example, backer fields 360 are positioned to extend across openings of and to close auxiliary chambers 30 of accessory tray 26 to maintain accessory items 22 therein due to the elimination of backer card 160. Since backer fields 360 are now visible from the front of package and product assembly 10 through accessory tray 26 and around accessory items 22, in one embodiment, it is generally desirable to present a plain or decorative backer field 360 as opposed to the rough and/or otherwise unfinished surface of the corrugated cardboard box blank.

In one embodiment, a suitable adhesive 370, which is generally indicated by the hatching in FIG. 15, is applied over a substantial entirety of a portion of inside surface 51 defined by backer panel 302 other than backer fields 360 or at least a part of inside surface 51 defined by backer panel 302 that surrounds backer fields 360. As such, when backer panel 302 is folded about fold line(s) 50J in a similar manner as described above with respect to front panel 100 backer panel 302 is adhered to front panel 100 effectively securing accessory items 22 within their respective auxiliary chambers 30. Of note, where more than one auxiliary chamber 30 is included, adhesive 370 extends between such auxiliary chamber(s) 30 to prevent or at least decrease inadvertent intermixing of accessory items 22 maintained in the respective auxiliary chamber 30. In view of the above, backer panel 302 is one example of means for backing accessory tray(s) 26 to enclose accessory item(s) 22 therebetween, e.g., within auxiliary chamber(s) 30.

In one example, backer panel 302 includes at least one perforated closed or otherwise suitably shaped portion 380 substantially near an outer perimeter of a corresponding backer field 360. Perforated portion 380 is configured to facilitate the end consumer in opening box 324 to access accessory item(s) 22 by tearing back the perforated portion 380, thereby, exposing auxiliary chamber(s) 30. Box 324 and the associated product and packaging assembly as a whole are otherwise assembled in a manner substantially similar as described above with respect to box 24 as will be apparent to those of skill in the art upon reading this application.

Although the invention has been described to particular embodiments, such embodiments are for illustrative purposes only and should not be considered to limit the invention. Various alternatives and modifications within the scope of the invention in its various embodiments will be apparent to those with ordinary skill in the art.

What is claimed is:

1. A method of assembling and displaying an assembly for retail sale, the method comprising:

providing a box including a first panel and sidewalls extending around the first panel to define a storage compartment therebetween, wherein an opening to the storage compartment is defined opposite the first panel, the box further includes a second panel extending from one of the sidewalls, and the second panel includes an aperture extending therethrough;

positioning a primary article in the storage compartment;

providing a tray including a frame panel, a front wall, and a tray sidewall extending between the frame panel and the front wall to define an auxiliary chamber between the front wall and the tray sidewall, the frame panel surrounding the auxiliary chamber, and the auxiliary chamber being filled with accessory articles;

positioning the tray relative to the box such that the front wall and the tray sidewall extend through the aperture to a side of the second panel opposite the first panel, and the frame panel is located between the first panel and the second panel; and folding the second panel relative to the one of the sidewalls to extend over a portion of the primary article adjacent the opening, the portion of the primary article being less than all of the primary article, wherein the auxiliary chamber extends from the second panel beyond a surface of the second panel opposite the primary article.

2. The method of claim 1, wherein providing the box includes providing the box including a backer panel extending from an edge of the second panel opposite the one of the sidewalls, and the method further comprises folding the backer panel about a second fold line defined along the edge of the second panel to extend over an inside surface of the second panel in a manner interposing the frame panel of the tray between the second panel and the backer panel, wherein folding the backer panel occurs prior to folding the second panel, and folding the second panel includes positioning the backer panel between the second panel and the storage compartment.

3. The method of claim 2, wherein providing the box includes providing the box formed as a single piece of material.

4. A package comprising:

a box including a rear panel, sidewalls extending around the rear panel, and a front panel, wherein the box defines a storage compartment between the rear panel and the sidewalls, an opening to the storage compartment is defined opposite the rear panel, the front panel extends over a portion of the opening to the storage compartment, the portion of the opening is less than all of the opening, and the front panel includes an aperture extending therethrough;

a tray defining an auxiliary chamber and a substantially planar, frame portion extending around the auxiliary chamber;

wherein the tray is positioned adjacent the front panel such that the frame portion is maintained between the front panel and the storage compartment and the auxiliary chamber forwardly extends though the aperture of the front panel beyond a surface of the front panel defined opposite the frame portion.

5. The package of claim 4, wherein the sidewalls include a lateral sidewall, the front panel is positioned adjacent the lateral sidewall along a first fold line, and the front panel is folded about the first fold line to extend substantially perpendicularly to the lateral sidewall in front of the portion of the storage compartment.

6. The package of claim 5, wherein the box further includes a backer panel extending from an edge of the front panel opposite the lateral sidewall, the backer panel is folded about a second fold line defined along the edge of the front panel to extend over an inside surface of the front panel in a manner interposing the frame portion of the tray between the front panel and the backer panel, and the backer panel is positioned between the front panel and the storage compartment.

7. The package of claim 6, wherein the tray defines an opening to the auxiliary chamber, and the package further comprises a backer card secured to the frame portion and extending over the opening to the auxiliary chamber to close the auxiliary chamber, the backer card being positioned between the front panel and the backer panel.

8. The package of claim 6, wherein the backer panel is adhered to the inside surface of the front panel and includes a perforation configured to facilitate detachment of a portion of the backer panel to expose the auxiliary chamber through the backer panel.

9. The package of claim 5, wherein the box defines a slot adjacent the rear panel, and the box further comprises:

a wrapping panel extending from a second fold line adjacent the front panel; and a locking tab extending from a third fold line adjacent the wrapping panel opposite the second fold line;

wherein the wrapping panel is folded about the second fold line to extend from the second fold line substantially perpendicularly to the front panel and over a second one of the sidewalls, and the locking tab is received by the slot to secure the front panel and the wrapping panel in place relative to the storage compartment.

10. The package of claim 9, wherein the second fold line extends substantially perpendicularly to the first fold line and substantially parallel to the third fold line.

11. The package of claim 5, wherein at least three of the sidewalls of the box are dual-panel sidewalls, and a flange extends from the lateral sidewall and is positioned between panels of an adjacent one of the sidewalls.

12. The package of claim 4, wherein the tray is one of transparent and translucent.

13. The package of claim 4, wherein the tray includes sides extending from the frame portion and a front wall extending from the sides opposite the frame portion to define the auxiliary chamber between the sides and the front wall.

14. The package of claim 4, wherein the box is formed from a single piece of material.

15. The package of claim 14, wherein the material is corrugated cardboard.

16. The package of claim 4, further comprising a corner panel extending over a corner of the opening to the storage compartment near an edge of the opening opposite the front panel.

17. The package of claim 4, in combination with a primary item placed within the storage compartment and an accessory item placed within the auxiliary chamber, wherein the primary item defines a front surface positioned opposite the rear panel of the box, the front panel extends over a first portion of the front surface of the primary item, and a second portion of the front surface of the primary item is physically exposed to an external environment surrounding the package via the opening to the storage compartment.

18. The combination of claim 17, wherein the primary item includes at least one of a dry erase board, a bulletin board, and a magnetic board, and the accessory item includes at least one of a writing instrument, a thumb tack, a magnet, and mounting hardware.

* * * * *